US009969190B2

(12) United States Patent
Nomura et al.

(10) Patent No.: US 9,969,190 B2
(45) Date of Patent: May 15, 2018

(54) CUTTER DRIVE MECHANISM, CUTTER, AND PRINTER

(71) Applicant: Seiko Epson Corporation, Tokyo (JP)

(72) Inventors: Akio Nomura, Shiojiri (JP); Rikuo Yamada, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 180 days.

(21) Appl. No.: 14/824,484

(22) Filed: Aug. 12, 2015

(65) Prior Publication Data

US 2016/0052307 A1 Feb. 25, 2016

(30) Foreign Application Priority Data

Aug. 25, 2014 (JP) ..... 2014-170179
Jul. 6, 2015 (JP) ..... 2015-135026

(51) Int. Cl.

| | |
|---|---|
| ***B26D 5/08*** | (2006.01) |
| ***B26D 5/16*** | (2006.01) |
| ***B41J 11/70*** | (2006.01) |
| ***B26D 5/14*** | (2006.01) |
| ***B26D 1/06*** | (2006.01) |
| *B26D 1/00* | (2006.01) |

(52) U.S. Cl.

CPC ..... *B41J 11/70* (2013.01); *B26D 1/065* (2013.01); *B26D 5/14* (2013.01); *B26D 2001/0066* (2013.01)

(58) Field of Classification Search

CPC .. B26D 1/065; B26D 2001/0066; B26D 5/14; B26D 5/16; B41J 11/70; B41J 11/703; B41J 11/66

USPC ... 83/51, 561, 575, 585, 589, 211, 614, 563, 83/746, 602, 694, 582, 607, 628; 400/621, 621.1

See application file for complete search history.

(56) References Cited

U.S. PATENT DOCUMENTS 4,936,177 A * 6/1990 Ozawa ..... B26D 1/085 83/582
5,957,597 A * 9/1999 Kato ..... B26D 1/305 400/621

(Continued)

FOREIGN PATENT DOCUMENTS

JP 10-217182 A 8/1998
JP 10-249788 A 9/1998

(Continued)

*Primary Examiner* — Ghassem Alie
*Assistant Examiner* — Bharat C Patel
(74) *Attorney, Agent, or Firm* — Foley & Lardner LLP

(57) ABSTRACT

A cutter can move a movable knife by two cutter drive gears without the movable knife becoming skewed. The cutter 10 of a mobile printer 1 has a fixed knife 11, and a cutter drive mechanism 32 that moves the movable knife 31 straight to and away from the fixed knife 11. The cutter drive mechanism 32 has two cutter drive gears 51 that are driven synchronously, and a cutter drive plate 54 disposed between the two cutter drive gears 51 and the movable knife 31. The two cutter drive gears 51 cause the cutter drive plate 54 to move to and away from the movable knife 31 on a longitudinal axis Y (direction of travel), thereby moving the movable knife 31 to and away from the cutter drive plate 54. If the cutter drive plate 54 becomes skewed when the two cutter drive gears 51 move the cutter drive plate 54, the guide mechanism 81 prevents skewing of the movable knife 31.

6 Claims, 8 Drawing Sheets

(56) References Cited

U.S. PATENT DOCUMENTS 5,974,930 A * 11/1999 Longrod ..... B26D 1/085 235/31 R
6,109,154 A * 8/2000 Miyatsu ..... B26D 1/085 83/202
6,152,007 A * 11/2000 Sato ..... B26D 1/0006 83/202
6,405,625 B1 * 6/2002 Nomura ..... B41J 15/042 83/214
6,508,600 B1 * 1/2003 Nonaka ..... B26D 1/085 101/227
6,786,125 B2 * 9/2004 Imai ..... B41J 11/70 192/48.92
6,831,670 B2 * 12/2004 Fujiwara ..... B41J 11/006 346/24
7,267,500 B2 * 9/2007 Tsuchiya ..... B26D 1/085 400/621
7,392,731 B2 * 7/2008 Nonaka ..... B26D 1/0006 101/227
7,819,599 B2 * 10/2010 Kobayashi ..... B26D 1/085 400/621
8,651,002 B2 * 2/2014 Sato ..... B26D 1/085 83/582
8,662,771 B2 * 3/2014 Kawaguchi ..... B26D 1/085 400/621
8,777,502 B2 * 7/2014 Shirotori ..... B41J 3/4075 400/621
8,783,984 B2 * 7/2014 Kim ..... B41J 3/4075 400/621
2006/0269346 A1 * 11/2006 Takayama ..... B26D 1/305 400/613
2007/0199422 A1 * 8/2007 Kawaguchi ..... B26D 1/0006 83/583
2007/0253759 A1 * 11/2007 Saito ..... B41J 11/666 400/621
2010/0043617 A1 2/2010 Sato
2010/0086340 A1 * 4/2010 Takami ..... B26D 7/088 400/621
2010/0143018 A1 * 6/2010 Kawaguchi ..... B26D 1/085 400/621
2012/0057918 A1 * 3/2012 Eoka ..... B26D 1/085 400/621

FOREIGN PATENT DOCUMENTS

JP 2005-161481 A 6/2005
JP 2005-324301 A 11/2005
JP 2008-68340 A 3/2008

* cited by examiner (a)

(b)

(a)

(b)

CUTTER DRIVE MECHANISM, CUTTER, AND PRINTER

BACKGROUND

1. Technical Field

The present invention relates to a cutter drive mechanism that transfers power through two gears to move a movable knife in a straight line to a fixed knife to cut media, to a cutter, and to a printer having the cutter.

2. Related Art

JP-A-H10-217182 describes a cutter having a fixed knife, a movable knife, and a cutter drive mechanism that moves the movable knife in a straight cutting direction to and away from the fixed knife. The cutter drive mechanism described in JP-A-H10-217182 also has a motor as the drive source, two cutter drive gears to which drive power is transferred from the motor, and a guide that guides the movable knife.

The two cutter drive gears are disposed in a direction perpendicular to the cutting direction of the movable knife. The two cutter drive gears also mesh together and rotate synchronously. Each cutter drive gear has a drive pin disposed offset from the center of the gear. The movable knife has two slots in which the drive pins of the cutter drive gears are disposed. The long axes of the two slots are perpendicular to each other, and the slots extend in perpendicular directions.

When the two cutter drive gears are driven by the motor, the drive pins move in the cutting direction of the movable knife while moving perpendicularly to each other in the slots. The drive pins therefore meet the end of the slots in the movable knife, and move the movable knife in the retracting direction. During one rotation of the cutter drive gears, the movable knife travels one round trip between the cutting position crossing with the fixed knife, and the standby position where there is a gap between the movable knife and the fixed knife.

If there is a phase difference between the two drive pins due to manufacturing tolerances, for example, in a cutter drive mechanism that uses two cutter drive gears to transfer power to the movable knife, the movable knife may become skewed.

When the movable knife becomes skewed, the behavior (operation) of the movable knife will become unstable if a relatively large amount of play is not provided between the movable knife and the guide. More specifically, when there is little play between the movable knife and the guide, the movable knife becomes skewed, and the movable knife and guide interfere with each other, power is transferred to the movable knife by only one drive pin, and the action of the movable knife becomes unstable. However, providing a large amount of play between the guide and movable knife allows the movable knife to become skewed, the movable knife and the fixed knife do not cross properly, and the quality of cutting the media drops.

SUMMARY

A cutter drive mechanism, a cutter, and a printer having the cutter according to the invention enable moving the movable knife by two cutter drive gears without the movable knife skewing.

A cutter drive mechanism according to the invention moves a movable knife straight to and away from a fixed knife, and has: two cutter drive gears driven synchronously; and a cutter drive plate disposed between the two cutter drive gears and the movable knife. The two cutter drive gears move the cutter drive plate in a direction of travel to and away from the movable knife; and the movable knife moves in the direction of travel in conjunction with movement of the cutter drive plate in the direction of travel.

Thus comprised, drive power from the two cutter drive gears is transferred through the cutter drive plate to the movable knife. Therefore, the movable knife can be prevented by the guide from becoming skewed in the event the cutter drive plate becomes skewed when the two cutter drive gears drive the cutter drive plate back and forth. Furthermore, because there is no need to provide play between the guide and the movable knife when guides are used to prevent skewing of the movable knife, the movable knife and fixed knife can be made to cross and cut desirably.

Further preferably in another aspect of the invention, each cutter drive gear has a drive pin at a position offset from the axial center of the cutter drive gear; the cutter drive plate has two slots to which the drive pins of the cutter drive gears are inserted, and a movable knife drive pin disposed between the two slots; and the movable knife has a round hole in which the movable knife drive pin is inserted.

If there is a phase difference between the two drive pins due to tolerances, for example, the cutter drive plate may become skewed when moving in the direction of travel. Because transfer of power from the cutter drive plate to the movable knife is done through the drive pin of the cutter drive plate that is inserted to a round hole in the movable knife, skewing of the cutter drive plate to the movable knife is allowed, and skewing of the cutter drive plate does not affect the orientation of the movable knife. Therefore, the movable knife can be moved straight back and forth while being held in a specific position.

Further preferably in another aspect of the invention, the round hole is disposed to the center of the cutting edge of the movable knife on the transverse axis perpendicular to the direction of travel of the movable knife.

Because drive power from the cutter drive plate is transferred to the center of the cutting edge of the movable knife, skewing of the cutting edge of the movable knife to the fixed knife can be prevented or suppressed.

Further preferably in another aspect of the invention, the cutter drive mechanism also has a guide mechanism that guides the movable knife in the direction of travel.

Thus comprised, the movable knife can be moved in a straight line while held in a specific position.

Further preferably in another aspect of the invention, the movable knife moves bidirectionally between a cutting position where the cutting edge of the movable knife and the cutting edge of the fixed knife cross, and a standby position where there is a gap between the cutting edge of the movable knife and the cutting edge of the fixed knife, while the cutter drive gears turn one revolution; the slots extend on the transverse axis of the movable knife perpendicular to the direction of travel; a curved part that curves in an arc in the direction away from the axis of rotation of the cutter drive gears is disposed in the middle of the transverse axis of each slot; and the movable knife is in the standby position when the drive pin is in the curved part.

Thus comprised, when the movable knife is in the standby position, an impact is applied to the cutter drive mechanism, and the drive pin and the edge of the slot in the movable knife collide, the drive pin producing a moment on the cutter drive gears that causes the cutter drive gears to turn can be prevented or suppressed. Movement of the movable knife to the fixed knife side due to the force of impact can therefore be prevented or suppressed.

Another aspect of the invention is a cutter including a movable knife, and a cutter drive mechanism described above, the cutter drive mechanism moving the movable knife in a direction of travel.

A cutter according to the invention can easily hold the movable knife in a specific position (orientation) when the movable knife is moved to and from the fixed knife. The cutting quality of the cutter can therefore be maintained.

Another aspect of the invention is a printer including: a printhead; the cutter described above; and a conveyance mechanism that conveys sheet media through a conveyance path passing the printing position of the printhead and the cutting position of the cutter.

A printer according to the invention can cut printed media with a cutter that maintains consistent cutting quality.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a mobile printer according to the invention is described below with reference to the accompanying figures.

Figure 1:
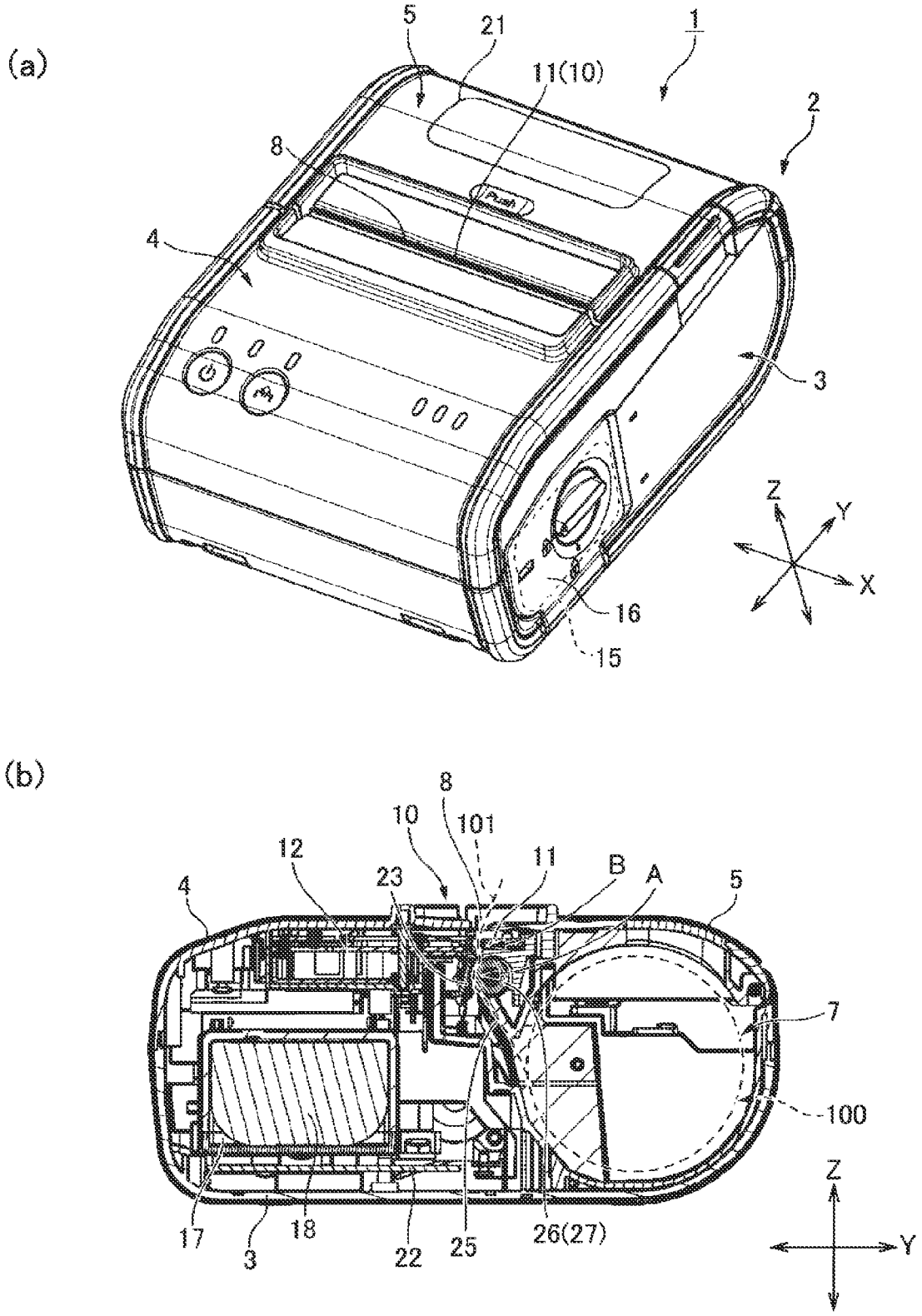
FIG. 1 is an oblique view and a section view of a mobile printer according to the invention.

FIG. 1A is an oblique view of a mobile printer according to this embodiment, and FIG. 1B is a section view of the mobile printer. For convenience in the following description, the direction widthwise to the mobile printer 1 as shown in FIG. 1 is referred to as the transverse axis X, the front-back direction as the longitudinal axis Y, and the axis perpendicular to the transverse axis X and longitudinal axis Y as the vertical axis Z. The left and right sides of the mobile printer 1 are also the sides on the left and right when looking at the mobile printer 1 from the front.

As shown in FIG. 1A, the mobile printer 1 has a printer case 2 with a basically long box shape. As shown in FIG. 1B, the printer case 2 includes a bottom case 3 that is open at the top, a top case 4 covering the top of the front part of the bottom case 3, and an access cover 5 covering the top of the back part of the bottom case 3. The access cover 5 can pivot at the back end thereof to open and close. A roll paper compartment 7 is disposed between the access cover 5 and the bottom case 3. Opening the access cover 5 opens the roll paper compartment 7 and enables loading a recording paper roll 100 in the roll paper compartment 7.

A recording paper exit 8 extending on the transverse axis X is formed between the access cover 5 and the top case 4. The fixed knife 11 of a paper cutter 10 is disposed inside the access cover 5 along the front edge defining the paper exit 8.

An opening 15 is formed in the right side at the front of the bottom case 3. A second access cover 16 that opens and closes the opening 15 is also attached to the bottom case 3. The opening 15 communicates with a battery compartment 17 disposed in the front part of the mobile printer 1. A rectangular battery 18 is installed in the battery compartment 17 through the opening 15.

Figure 2:
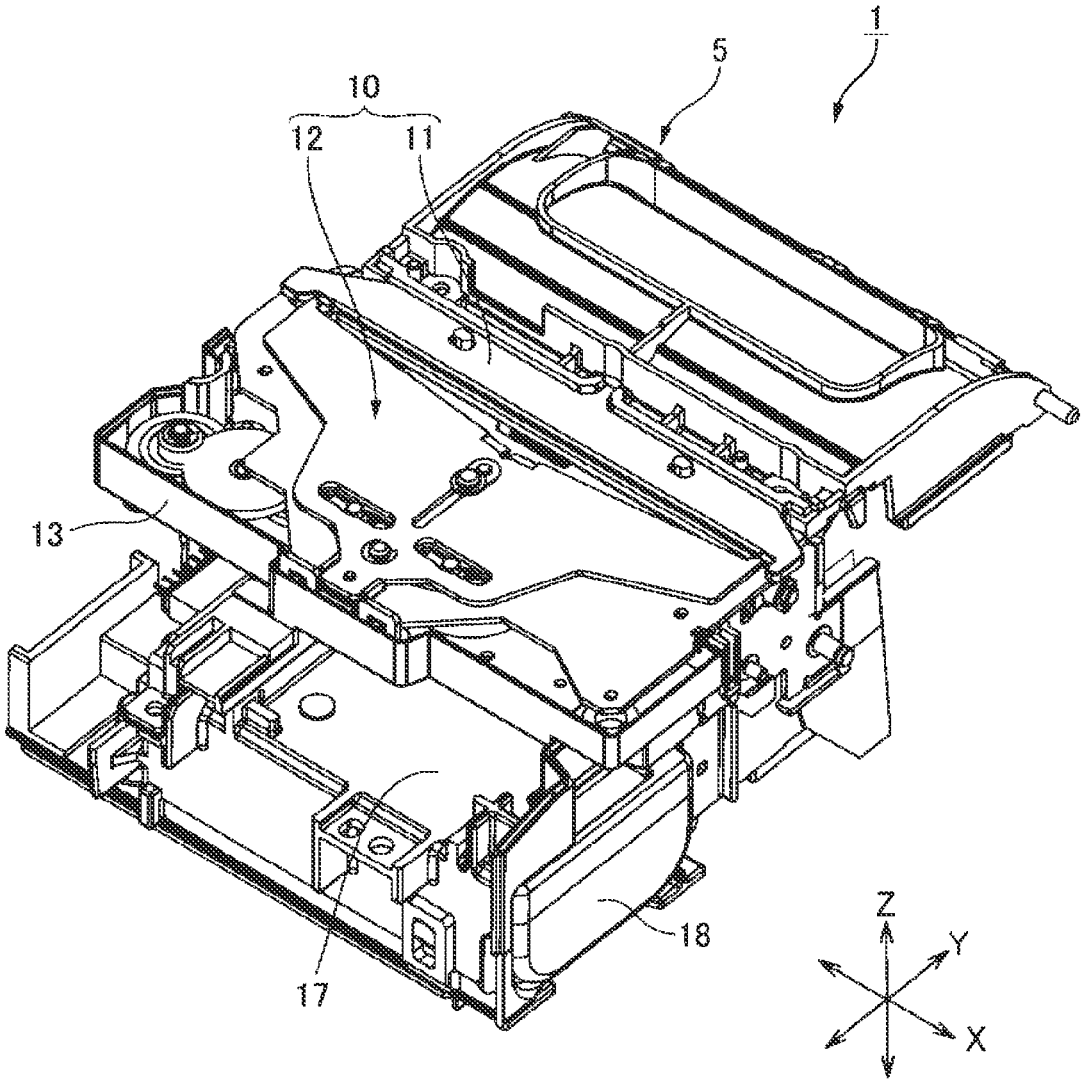
FIG. 2 is an oblique view of the mobile printer with the case removed.

FIG. 2 is an oblique view of the mobile printer 1 without the top case 4 and bottom case 3. The top outside panel 21 (see FIG. 1A) of the access cover 5 is also omitted in FIG. 2. As shown in FIG. 1B and FIG. 2, a cutter unit 12 that together with the fixed knife 11 embodies the cutter 10 is disposed above the battery compartment 17 at the front part of the mobile printer 1. The bottom of the cutter unit 12 is covered by a box-like watertight case 13, and the top is covered by the top case 4. A circuit board 22 is disposed below the battery compartment 17 at the front of the mobile printer 1 as shown in FIG. 1B.

A printhead 23 is disposed facing the back as shown in FIG. 1B between the battery compartment 17 and the roll paper compartment 7 on the longitudinal axis Y. The printhead 23 is a thermal head.

A recording paper conveyance path 25 is formed from the roll paper compartment 7 sequentially passing the printing position A of the printhead 23 and the cutting position B of the cutter 10 between the battery compartment 17 and roll paper compartment 7 on the longitudinal axis Y.

A platen roller 26 extending on the transverse axis X is opposite the head surface of the printhead 23 from the back. The platen roller 26 is rotationally driven by a paper feed motor not shown that is driven by power from the battery 18. The platen roller 26 embodies a conveyance mechanism 27 that conveys the recording paper 101 delivered from the paper roll 100 through the recording paper conveyance path 25.

The printhead 23 prints on the recording paper 101 conveyed through the recording paper conveyance path 25 as the recording paper 101 passes the printing position A. When the printed portion of the recording paper 101 has passed the cutting position B, the cutter unit 12 is driven to cut the printed portion with the cutter 10.

Cutter

Figure 3:
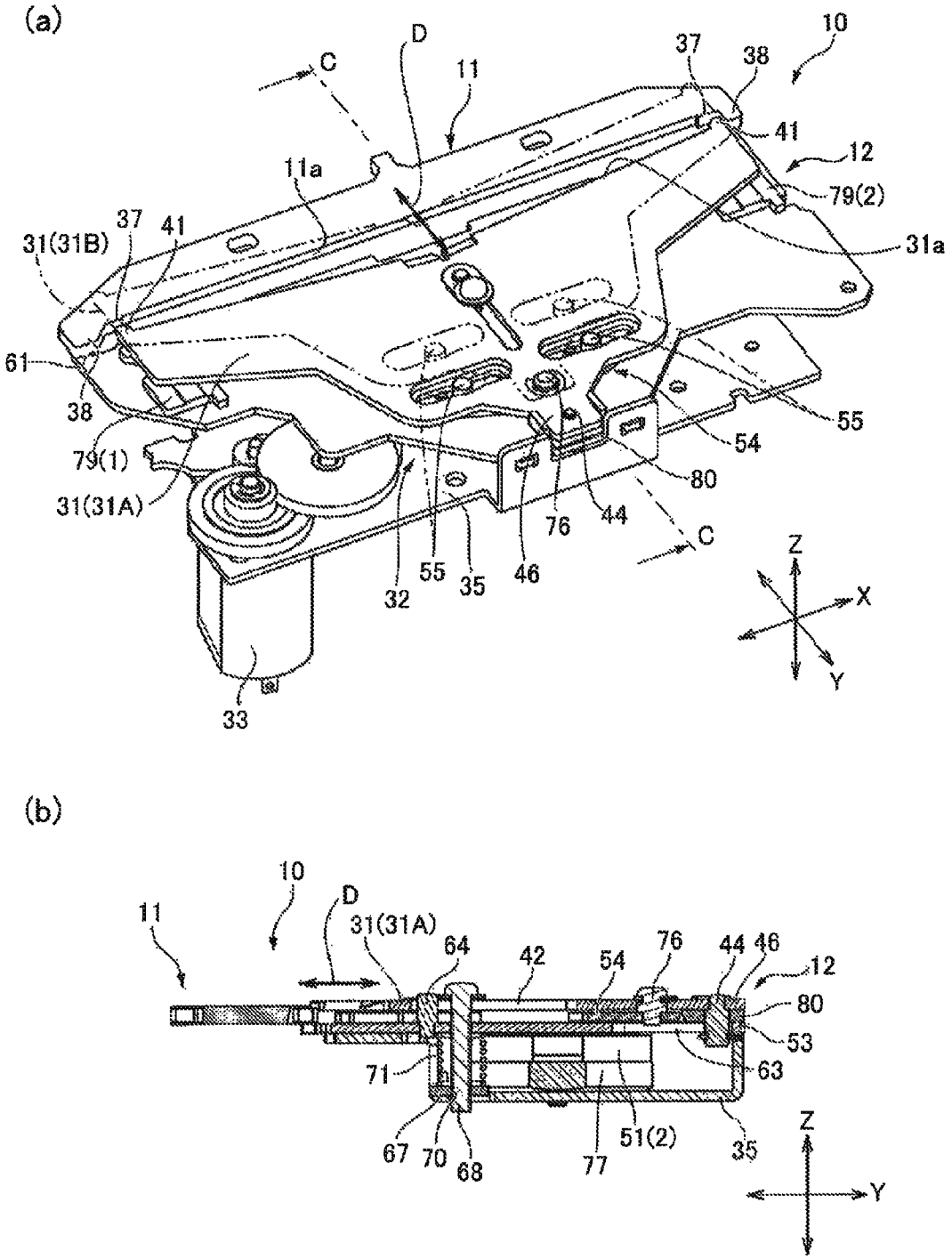
FIG. 3 is an oblique view and a section view of the cutter.

FIG. 3 (A) is an oblique view of the cutter 10, and FIG. 3B is a section view of the cutter 10 through line C-C in FIG. 3A. FIG. 4A is an oblique view of the cutter unit 12 without the movable knife, and FIG. 4B is a plan view when the movable knife and cutter frame have been removed from the cutter unit 12. FIG. 5A is an oblique view from above of the movable knife, cutter drive plate, and cutter frame, and FIG. 5B is an oblique view from below of the movable knife, cutter drive plate, and cutter frame.

Figure 4:
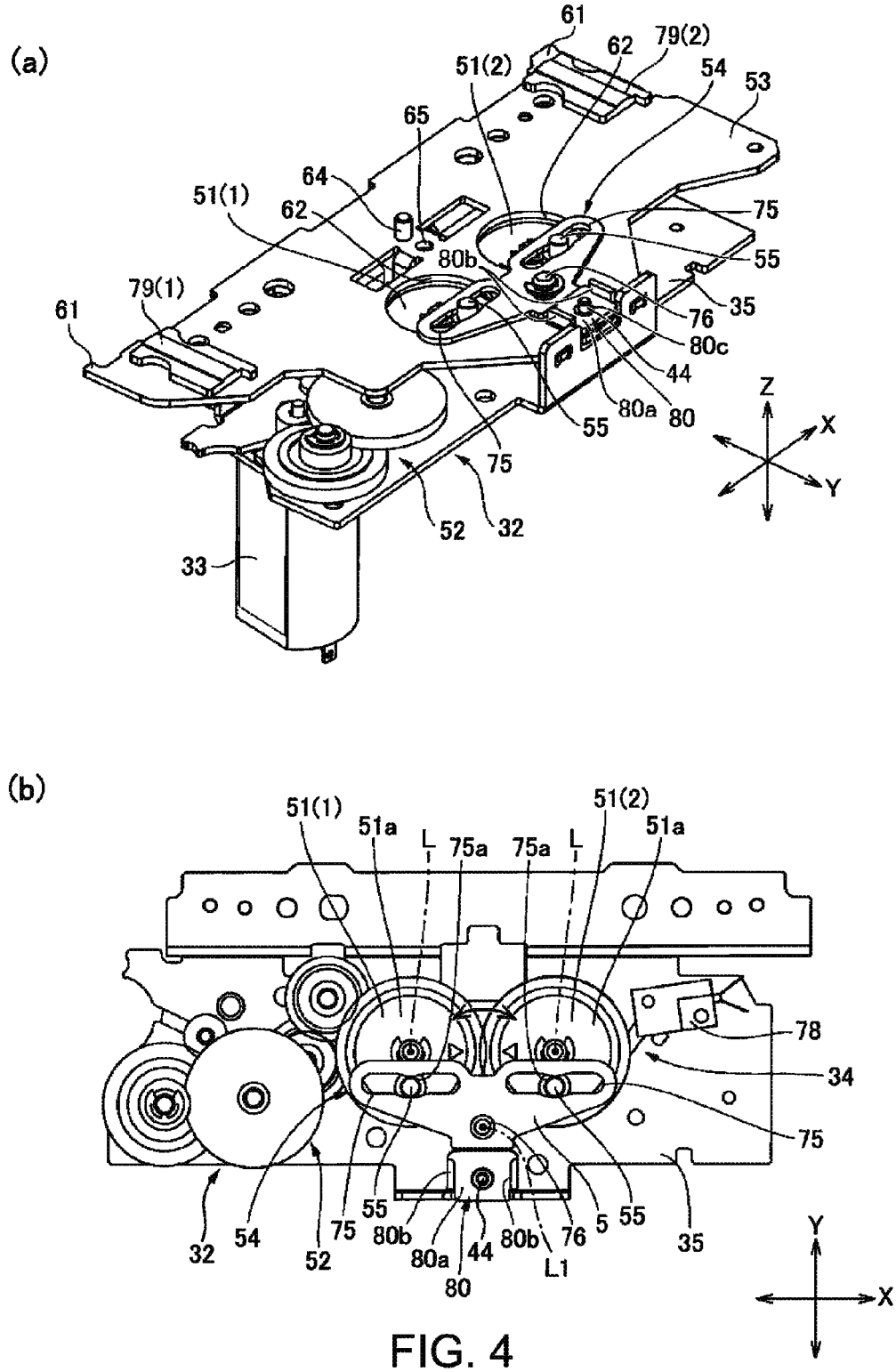
FIG. 4 illustrates the cutter with the movable knife or the cutter frame removed.

As shown in FIG. 3, the cutter 10 includes a fixed knife 11 and the cutter unit 12 opposite the fixed knife 11. As shown in FIG. 3 and FIG. 4, the cutter unit 12 also includes a movable knife 31; a cutter drive mechanism 32 that moves the movable knife 31 in the cutting direction approaching the fixed knife 11, and the retracting direction D away from the fixed knife 11; a cutter motor 33 as the drive source of the cutter drive mechanism 32; a position detection mechanism 34 (see FIG. 4) that detects the position of the movable knife 31; and a unit frame 35 that carries these other components.

The retracting direction D of the movable knife 31 is on the longitudinal axis Y of the mobile printer 1. As shown in FIG. 1B, the fixed knife 11 is fixed on the access cover 5, and the cutter unit 12 is attached to the top case 4.

The cutter motor 33 is a DC motor. When the cutter motor 33 is driven and the cutter drive mechanism 32 operates, the movable knife 31 moves bidirectionally between a standby position 31A where there is a gap between the cutting edge 31*a* of the movable knife 31 and the cutting edge 11*a* of the fixed knife 11, and the cutting position 31B where the cutting edge 31*a* crosses the cutting edge 11*a* of the fixed knife 11, as shown in FIG. 3A.

The fixed knife 11 is a flat plate and is left-right symmetrical in plan view. A cutting edge 11*a* extending straight on the transverse axis X is formed in the middle of the front edge of the fixed knife 11 (on the side facing the cutter unit 12). The fixed knife 11 also has an uplift guide 37 that protrudes to the cutter unit 12 side from each end of the cutting edge 11*a*. The fixed knife 11 also has fixed knife side protrusions 38, which protrude further to the front (toward the cutter unit 12) than the uplift guides 37, formed outside the uplift guide 37 on the transverse axis X.

Figure 5:
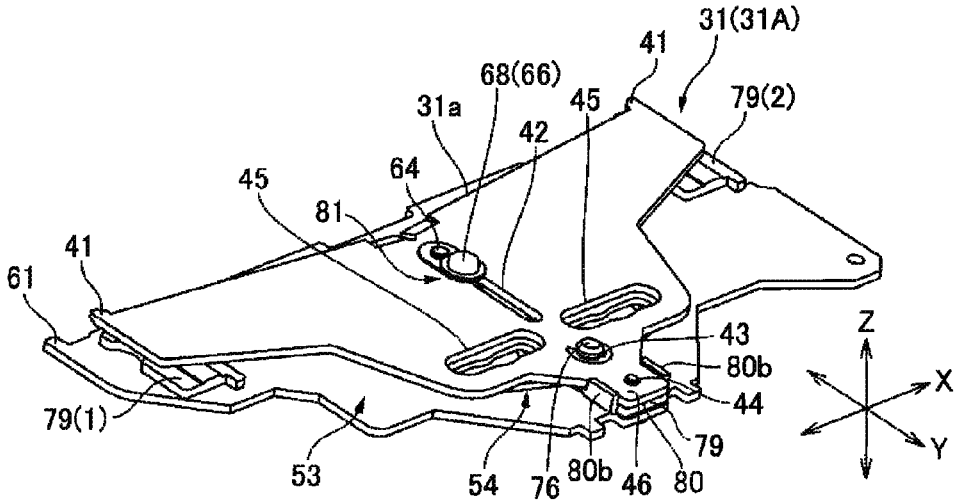
FIG. 5 illustrates the movable knife, cutter drive plate cutter drive plate, and cutter frame.
Figure 5:
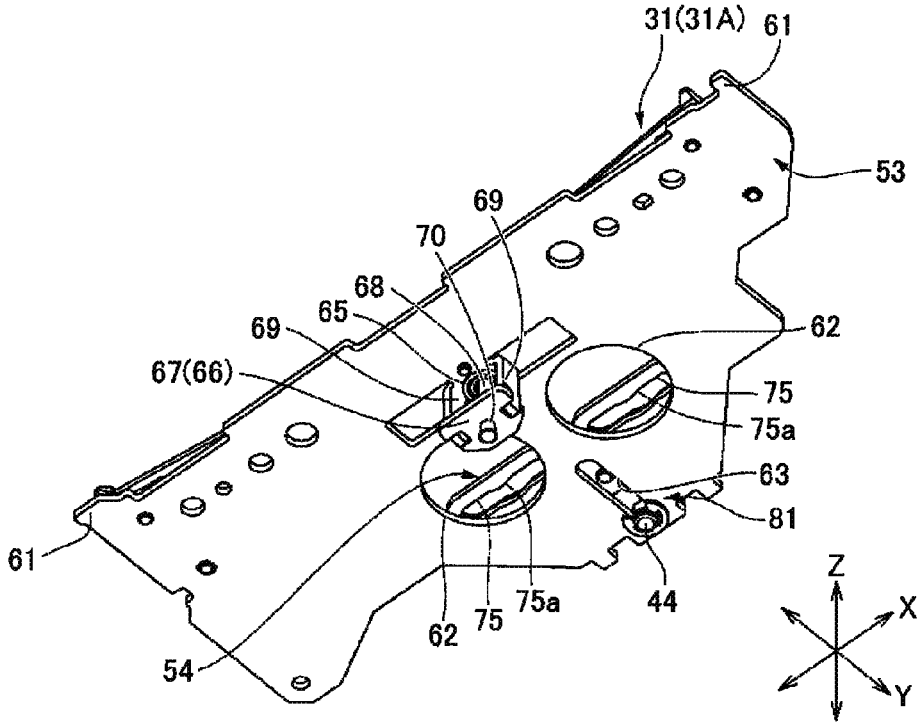

As shown in FIG. 5 (A), the movable knife 31 is a flat plate, and is left-right symmetrical in plan view. A cutting edge 31*a* is formed on the back side of the movable knife 31 (on the side facing the fixed knife 11) with a V-shape that recedes in the middle on the transverse axis X to the front (away from the fixed knife 11). The movable knife 31 has a riser part 41 at each end of the cutting edge 31*a* protruding toward the fixed knife 11 side. The riser parts 41 are opposite the uplift guides 37 of the fixed knife 11 when the movable knife 31 is in the standby position 31A, and ride onto the uplift guides 37 as the movable knife 31 moves from the standby position 31A to the cutting position 31B.

The movable knife 31 has a movable knife-side guide slot 42 in the middle of the transverse axis X with its long axis aligned with the direction of travel of the movable knife 31 (the longitudinal axis Y). A drive pin insertion hole 43 is formed in the movable knife 31 in the middle of the transverse axis X and in front of the movable knife-side guide slot 42 (on the opposite side as the side where the fixed knife 11 is located). The drive pin insertion hole 43 is a round hole. A movable knife side guide pin 44 is disposed on the front side of the drive pin insertion hole 43 in the middle of the movable knife 31 on the transverse axis X. As shown in FIG. 5B, the movable knife side guide pin 44 extends down from the movable knife 31. Two movable knife side slots 45 are formed in the movable knife 31 between the drive pin insertion hole 43 and the movable knife-side guide slot 42 on the longitudinal axis Y. The two movable knife side slots 45 are disposed with the long axis aligned with the transverse axis X. The movable knife 31 also has a rectangular protrusion 46 that protrudes toward the front in the middle of the front end (the end on the opposite side as the fixed knife 11).

As shown in FIG. 4, the cutter drive mechanism 32 includes two cutter drive gears 51, a speed reducer gear train 52 that slows and transfers rotation of the cutter motor 33 to one of the two cutter drive gears 51 (cutter drive gear 51(1) in this example), a cutter frame 53 (FIG. 4A) disposed between the two cutter drive gears 51 and the movable knife 31, and a cutter drive plate 54.

The two cutter drive gears 51 mesh with each other on the transverse axis X. The two cutter drive gears 51 have the same number of teeth, and turn synchronously in different directions in response to the rotation transferred to the one cutter drive gear 51(1). Each cutter drive gear 51 has a drive pin 55 protruding in the direction of the axis of rotation L of the cutter drive gears 51 from a position offset from the center of the round top surface 51*a*.

The cutter frame 53 is flat plate. The cutter frame 53 is supported by the unit frame 35 with a slight gap between the top surface 51*a* and the top of the two cutter drive gears 51. The cutter frame 53 also has a protrusion 61 that protrudes from the back (the side toward the fixed knife 11) from the opposite ends on the transverse axis X to the back (the direction facing the fixed knife 11). As shown in FIG. 1B and FIG. 3A, the protrusions 61 contact the fixed knife side protrusions 38 of the fixed knife 11 from below.

As shown in FIG. 4A, the cutter frame 53 has two round holes 62 around the path through which the drive pins 55 travel when the cutter drive gears 51 turn.

As shown in FIG. 5B, the cutter frame 53 also has a frame-side guide hole 63 at a position on the front side (the opposite side as the side on which the fixed knife 11 is located) of the two round holes 62 in the center between the two round holes 62 when seen along the longitudinal axis Y. The frame-side guide hole 63 is long on the longitudinal axis Y, and has a length corresponding to the distance the movable knife 31 travels back and forth.

As shown in FIG. 4A, the cutter frame 53 also has a frame-side guide pin 64 at a position on the back side of the two round holes 62 (the same side as the fixed knife 11) at a position matching the frame-side guide hole 63 when seen on the longitudinal axis Y.

The cutter frame 53 also has a through-hole 65 formed between the frame-side guide pin 64 and the two round holes 62 at a position matching the frame-side guide hole 63 and frame-side guide pin 64 when seen from the longitudinal axis Y.

A screw retainer 67 is attached below the through-hole 65 in the cutter frame 53 as shown in FIG. 5B. The screw retainer 67 is supported displaceably vertically at the bottom end of tabs 69 that are punched down from the cutter frame 53. The screw retainer 67 has a threaded hole 70 matching a screw 68. As shown in FIG. 3B, a coil spring 71 is disposed between the bottom of the cutter frame 53 and the screw retainer 67.

Together with a screw 68 that is inserted from above through the movable knife-side guide slot 42 of the movable knife 31 and screwed into the threaded hole 70, the screw retainer 67 and coil spring 71 embody a dropout prevention mechanism 66 that prevents the movable knife 31 from falling out.

As shown in FIG. 4, the cutter drive plate 54 is placed on top of the cutter frame 53 and supported slidably on the cutter frame 53. The cutter drive plate 54 has a constant thickness, and is left-right symmetrical when seen in plan view. The cutter drive plate 54 is small relative to the cutter frame 53 and movable knife 31.

The drive pins 55 of the cutter drive gears 51 protrude vertically through the round holes 62 in the cutter frame 53, and are respectively inserted to the two drive plate-side slots 75 formed in the cutter drive plate 54. The two drive plate-side slots 75 are aligned with the transverse axis X. The drive plate-side slots 75 extend on the transverse axis X. As shown in FIG. 4B and FIG. 5B, a curved part 75*a* that curves in an arc is disposed in the middle of each drive plate-side slot 75 on the transverse axis X. The curved part 75*a* protrudes in the direction away from the axis of rotation L of the cutter drive gears 51.

As shown in FIG. 4, the cutter drive plate 54 has a movable knife drive pin 76 at a location in front of the two drive plate-side slots 75 (on the opposite side as the side where the fixed knife 11 is located) and centered between the two drive plate-side slots 75 as seen from the longitudinal axis Y. The movable knife drive pin 76 is a round post, and protrudes vertically from the center of the cutter drive plate 54 on the transverse axis X.

The position detection mechanism 34 detects when the movable knife 31 is at the standby position 31A. The position detection mechanism 34 has a position detection cam 77 (FIG. 3B) and a mechanical switch 78 (FIG. 4B). Of the two cutter drive gears 51, the position detection cam 77 is disposed below and coaxially with the cutter drive gear 51(2) to which rotation of the cutter motor 33 is not transferred. The mechanical switch 78 is operated by the position detection cam 77. The position detection cam 77 operates the mechanical switch 78 when the cutter drive gear 51(2) rotates through a specific angular range setting the movable knife 31 to the standby position 31A.

Assembling the Cutter Unit

To assemble the cutter unit 12, the cutter motor 33, speed reducer gear train 52, two cutter drive gears 51, and position detection mechanism 34 are first mounted on the unit frame 35. Next, the cutter frame 53 is affixed to the unit frame 35. At this time, the drive pins 55 of the cutter drive gears 51 protrude above the cutter frame 53 through the two round holes 62 in the cutter frame 53. The cutter drive plate 54 is then placed on the cutter frame 53 with the tops of the drive pins 55 inserted to the drive plate-side slots 75. As a result, each drive pin 55 engages the matching drive plate-side slot 75 while being able to slide in the drive plate-side slot 75 on the transverse axis X. This position is illustrated in FIG. 4A.

Next, the movable knife 31 is attached to the cutter frame 53 from above the cutter drive plate 54 with three slides 79(1), 79(2), and 80 between the cutter frame 53 and the movable knife 31. Each of the slides 79(1), 79(2), and 80 is a plastic piece with low sliding resistance. As shown in FIG. 4A, two of the slides 79(1), 79(2) are affixed to the back of the cutter frame 53 at opposite ends on the transverse axis X. The remaining slide 80 is affixed to the front of the cutter frame 53 in the middle of the transverse axis X.

As shown in FIG. 4B, the one slide 80 includes a platform 80*a* on which the front protrusion 46 of the movable knife 31 rests, and a pair of protrusions 80*b* that protrude up from the opposite sides of the platform 80*a* on the transverse axis X with the protrusion 46 of the movable knife 31 therebetween on the transverse axis X. The top of the platform 80*a* is flat, and has a through-hole 80*c* in the center of the platform 80*a*.

When mounting the movable knife 31 on the cutter drive plate 54, the frame-side guide pin 64 of the cutter frame 53 is inserted to the movable knife-side guide slot 42 as shown in FIG. 5A. As a result, the frame-side guide pin 64 engages the movable knife-side guide slot 42 while being able to move on the longitudinal axis Y. As shown in FIG. 5B, the movable knife side guide pin 44 extending from the movable knife 31 passes through the through-hole 80*c* in the slide 80 and is then inserted to the frame-side guide hole 63 of the cutter frame 53. As a result, the movable knife side guide pin 44 causes the slide 80 to move with movable knife 31 on the longitudinal axis Y. The movable knife side guide pin 44 engages the frame-side guide hole 63 movably on the longitudinal axis Y. As also shown in FIG. 5A, the movable knife drive pin 76 of the cutter drive plate 54 is inserted to the drive pin insertion hole 43 of the movable knife 31. As a result, the movable knife drive pin 76 engages the drive pin insertion hole 43 while being able to rotate on its axis of rotation.

The screw 68 is then inserted from above the movable knife 31 through the movable knife-side guide slot 42 to the through-hole 65 in the cutter frame 53, and the screw 68 is screwed into the threaded hole 70 in the screw retainer 67. As a result, the head of the screw 68 contacts the edges of the movable knife-side guide slot 42 in the movable knife 31 from above, and prevents the movable knife 31 from falling out of the cutter frame 53. Note that the screw 68 screws into the threaded hole 70 in the screw retainer 67 until the coil spring 71 (see FIG. 3B) is compressed. The dropout prevention mechanism 66 therefore exerts an urging force urging the movable knife 31 toward the cutter frame 53.

A guide mechanism 81 that guides the movable knife 31 on the longitudinal axis Y (cutting/retraction direction) when the movable knife 31 is attached to the cutter frame 53 is embodied by the frame-side guide pin 64 of the cutter frame 53 and the movable knife-side guide slot 42 of the movable knife 31, and the movable knife side guide pin 44 of the movable knife 31 and the frame-side guide hole 63 of the cutter frame 53. The guide mechanism 81 guides the movable knife 31 straight in the longitudinal axis Y while holding the movable knife 31 in a specific position. Note that when the movable knife 31 is attached to the cutter frame 53, the drive pins 55 of the cutter drive gears 51 reach inside the movable knife side slots 45 of the movable knife 31, but do not contact the edges of the movable knife side slots 45. Furthermore, the screw 68 simply passes through the movable knife-side guide slot 42, and does not contact the edges of the movable knife-side guide slot 42 in the movable knife 31.

Cutting Recording Paper with the Cutter

The movable knife 31 of the cutter 10 starts at the standby position 31A. When the movable knife 31 is in the standby position 31A, the drive pins 55 of the cutter drive gears 51 are positioned in front of the axis of rotation L of the cutter drive gears 51 (on the opposite side as the side where the fixed knife 11 is located) centered on the transverse axis X between the drive plate-side slots 75 in the cutter drive plate 54 as indicated by the solid lines in FIG. 3. The position detection cam 77 of the position detection mechanism 34 operates the mechanical switch 78 when the drive pins 55 are in this position. Therefore, the position detection mechanism 34 detects that the movable knife 31 is in the standby position 31A.

When the printed portion of the recording paper 101 that was printed at the printing position A passes the cutting position B, the cutter motor 33 is driven to rotate the cutter drive gears 51 one turn. As a result, the movable knife 31 travels bidirectionally between the standby position 31A and the cutting position 31B, and cuts the recording paper 101 at the cutting position 31B.

More specifically, when the cutter motor 33 is driven, rotation of the cutter motor 33 is transferred through the speed reducer gear train 52 to the two cutter drive gears 51. When the two cutter drive gears 51 turn, the drive pins 55 move to the back approaching the fixed knife 11 on the longitudinal axis Y while moving on the transverse axis in the drive plate-side slots 75. Therefore, the drive pins 55 contact the open edge at the back of the drive plate-side slots 75 in the cutter drive plate 54, and move the cutter drive plate 54 back. The power transferred from the two cutter drive gears 51 to the cutter drive plate 54 is transferred through the movable knife drive pin 76 to the movable knife 31. The movable knife 31 therefore moves to the back in conjunction with movement of the cutter drive plate 54 and reaches the cutting position 31B. At the cutting position 31B, as indicated by the double-dash dot line in FIG. 3A, the drive pins 55 of the cutter drive gears 51 are located behind the axis of rotation L of the cutter drive gears 51 (the side where the fixed knife 11 is located). The drive pins 55 of the cutter drive gears 51 are centered on the transverse axis X in the drive plate-side slots 75 of the cutter drive plate 54.

If there is a phase difference in the two drive pins 55 due to tolerances, for example, the cutter drive plate 54 may become skewed when power is transferred thereto from the cutter motor 33 by the two cutter drive gears 51. In this example, when the cutter drive plate 54 becomes skewed as indicated by the arrow in FIG. 4B, it rocks on the axis L1 of the movable knife drive pin 76 inserted to the drive pin insertion hole 43 of the movable knife 31 when moving on the longitudinal axis Y.

In other words, the cutter drive plate 54 is allowed to rotate on the axis L1 relative to the movable knife 31. Skewing of the cutter drive plate 54 does not affect the orientation (position) of the movable knife 31. In other words, the movable knife 31 can be moved forward and back while remaining in a specific position. Because skewing of the cutter drive plate 54 thus does not affect the position (orientation) of the movable knife 31, there is no need to provide play in the guide mechanism 81. Skewing of the movable knife 31 can therefore be reliably prevented. The movable knife 31 therefore crosses the fixed knife 11 in a desirable position at the cutting position 31B, and cutting quality can be maintained when cutting the recording paper 101.

In this example, when looking from the longitudinal axis Y (cutting/retracting direction), the drive pin insertion hole 43 of the movable knife 31 is disposed to the center of the cutting edge 31*a* of the movable knife 31 on the transverse axis X of the movable knife 31. As a result, because drive force from the cutter drive plate 54 is transferred to the center of the cutting edge 31*a* of the movable knife 31, skewing of the cutting edge 31*a* relative to the fixed knife 11 can be prevented or suppressed.

When the two cutter drive gears 51 turn after the movable knife 31 reaches the cutting position 31B, the drive pin 55 moves forward on the longitudinal axis Y away from the fixed knife 11 while moving on the transverse axis X in the drive plate-side slots 75. The drive pins 55 therefore contact the open edge at the front of the drive plate-side slots 75 in the cutter drive plate 54, and move the cutter drive plate 54 toward the front (the direction away from the fixed knife 11). The power transferred from the cutter drive gears 51 to the cutter drive plate 54 is transferred through the movable knife drive pin 76 to the movable knife 31. The movable knife 31 therefore moves forward in conjunction with movement of the cutter drive plate 54 and returns to the standby position 31A.

When the movable knife 31 has returned to the standby position 31A, the drive pins 55 of the cutter drive gears 51 are positioned in front of the axis of rotation L of the cutter drive gears 51 (on the opposite side as the side where the fixed knife 11 is located). The drive pins 55 of the cutter drive gears 51 are also positioned in the drive plate-side slots 75 of the cutter drive plate 54 in the middle on the transverse axis X. The position detection mechanism 34 therefore detects that the movable knife 31 is in the standby position 31A.

Shape of the Drive Plate-Side Slot

The shape of the drive plate-side slots 75 formed in the cutter drive plate 54 is described in detail below. FIG. 6A is a plan view of the cutter drive plate 54 and two cutter drive gears 51 in this example, and FIG. 6B is a plan view of a cutter drive plate 54 and two cutter drive gears 51 that do not have the curved part 75*a* formed in the center of the drive plate-side slots 75 for comparison. In the positions shown in FIG. 6A and FIG. 6B, the movable knife 31 is at the standby position 31A.

In the example shown in FIG. 6A, a curved part 75*a* that curves in an arc away from the axis of rotation (axis of rotation L) of the cutter drive gears 51 is disposed to each drive plate-side slot 75 in the middle of the transverse axis X. The center of the arc defining the curved part 75*a* matches the axis of rotation L of the cutter drive gear 51. In this example, the movable knife 31 is in the standby position 31A when the drive pin 55 is in the curved part 75*a*.

In this example, when the movable knife 31 is in the standby position 31A, a shock is applied to the cutter drive mechanism 32, and the drive pin 55 and movable knife 31 (the edge of the curved part 75*a* in the movable knife 31) collide, the movable knife 31 can be prevented from moving from the standby position 31A. More specifically, when the drive pin 55 and the movable knife 31 collide while the drive pins 55 are in the curved part 75*a*, the force of impact (F) is directed to the axis of rotation L of the cutter drive gears 51 by the shape of the edge of the curved part 75*a*. The force of impact (F) can therefore be prevented or suppressed from producing a moment causing the cutter drive gears 51 to turn. Because the cutter drive gears 51 therefore do not turn, the movable knife 31 remains in the standby position 31A. As a result, the movable knife 31 does not move to the fixed knife 11 side and is safely protected even when the mobile printer 1 is hit sharply, for example.

Figure 6:
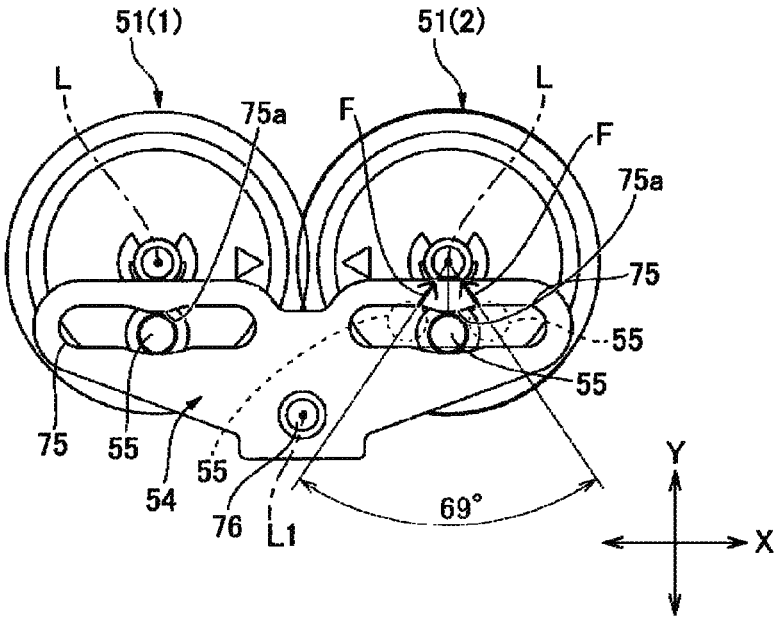
FIG. 6 illustrates the drive plate side slot in the cutter drive plate.
Figure 6:
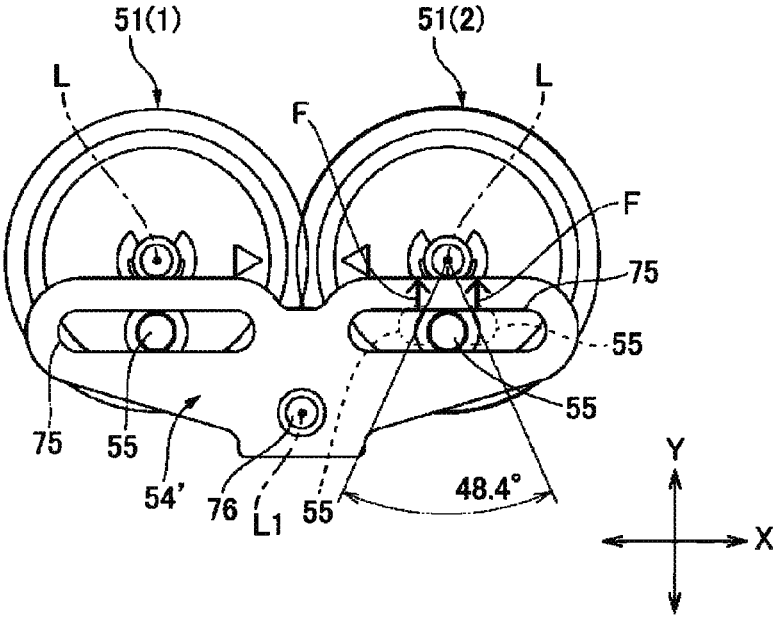

In the example shown in FIG. 6B, however, the middle of the drive plate-side slot 75 is a simple straight edge along the transverse axis X. In this event, as indicated by the dotted line in FIG. 6, if the position of the drive pin 55 is offset slightly from the center of the drive plate-side slot 75 on the transverse axis X, and a drive pin 55 collides with the edge of the drive plate-side slot 75 in the movable knife 31, the force of impact (F) produces a moment that causes the cutter drive gears 51 to turn. As a result of this impact, the cutter drive gears 51 may turn and the movable knife 31 move to the fixed knife 11 side.

Also in this example, the movable knife 31 can be held in the standby position 31A when the drive pins 55 are in the curved part 75*a*. The width of the angular range where the cutter drive gears 51 must be stopped to set the movable knife 31 to the standby position 31A can therefore be increased. Drive control of the cutter motor 33, which is a DC motor, can also be simplified.

For example, in an example in which a curved part 75*a* is disposed to the middle of the drive plate-side slot 75, the width of the angular position where the cutter drive gears 51 must be stopped to set the movable knife 31 to the standby position 31A is 69 degrees, as shown in FIG. 6A. However, when the middle of the drive plate-side slot 75 is defined by a straight edge, the width of the angular position where the cutter drive gears 51 must be stopped is 48.4 degrees, as shown in FIG. 6B.

Other Embodiments

Figure 7:
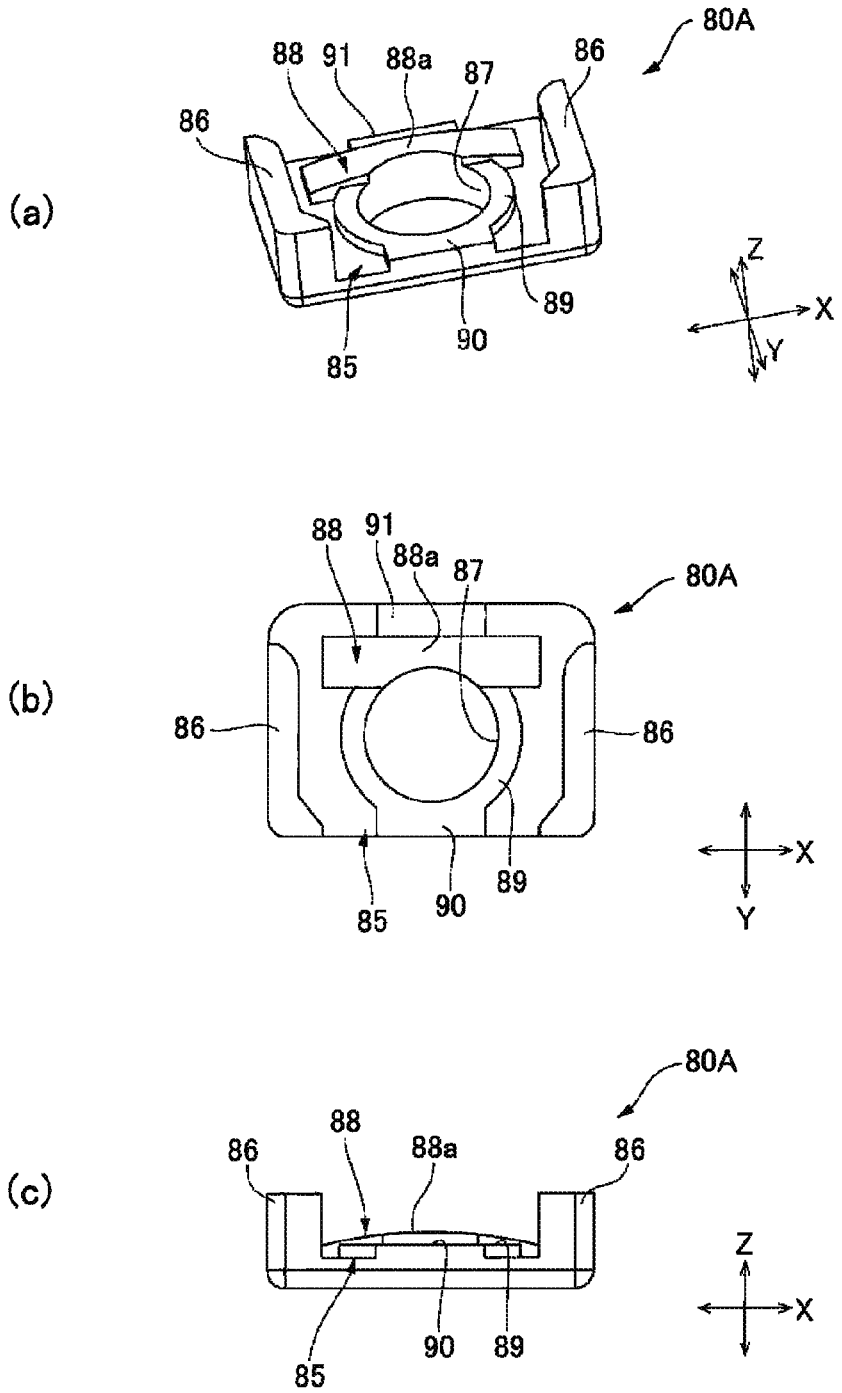
FIG. 7 is an oblique view, plan view, and front view of another example of the slide.
Figure 8:
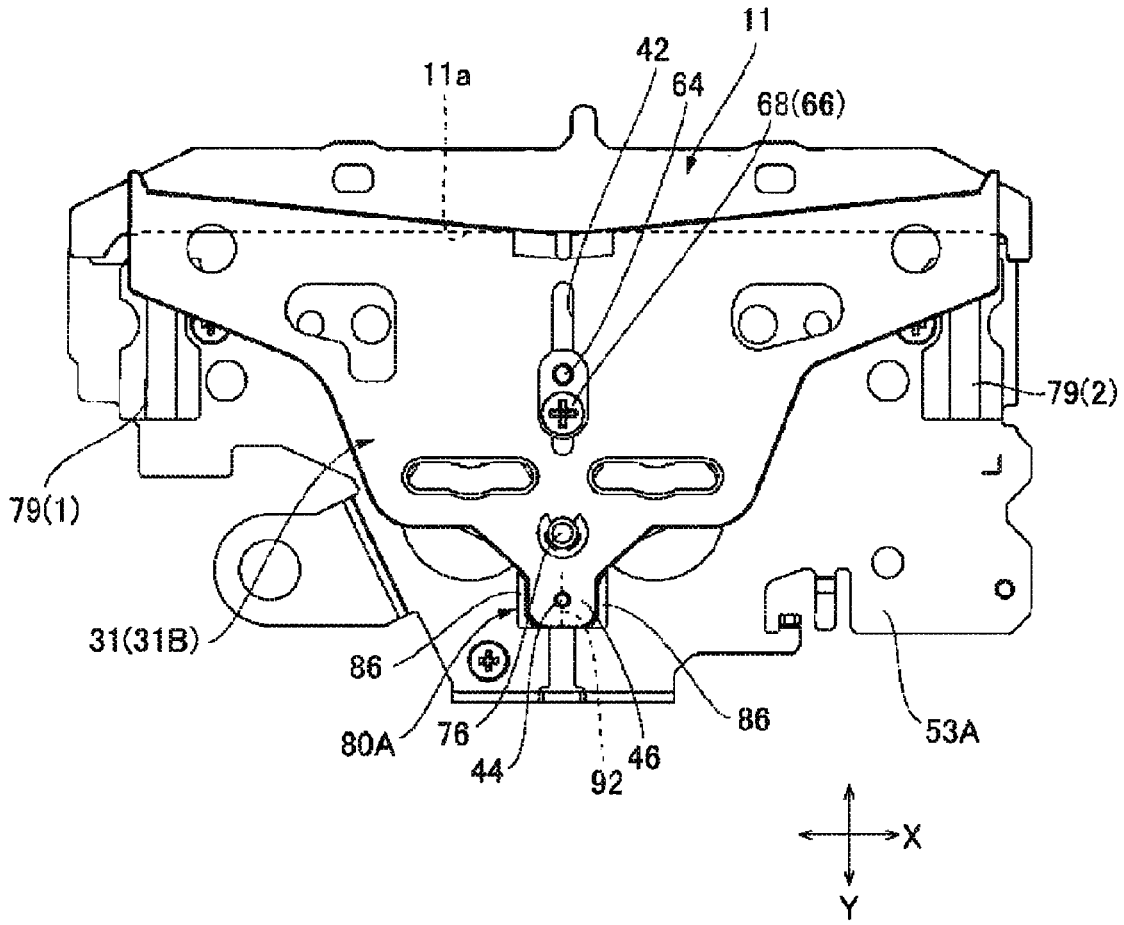
FIG. 8 illustrates the effect of the other example of the slide.

FIG. 7 is an oblique view, plan view, and front view of a slide according to another embodiment of the invention. FIG. 8 illustrates the effect of using the slide according to this embodiment in the cutter 10. Note that the outside shape of the cutter frame 53A in FIG. 8 differs in parts from the cutter frame 53 described above, but the main parts are the same. Like parts are therefore identified by like reference numerals, and further description thereof is omitted.

The slide 80A in this example is used instead of the slide 80 described above. Like the foregoing slide 80, this slide 80A is disposed between the cutter frame 53 and movable knife 31. The slide 80A is a plastic member with low sliding resistance.

As shown in roll paper compartment 7, the slide 80A has a platform 85 on which the protrusion 46 of the movable knife 31 rides, and protrusions 86 that protrude up from the opposite sides of the platform 85 on the transverse axis X. A through-hole 87 is disposed in the middle of the platform 85.

A rib 88 is disposed to the platform 85 at a position behind the through-hole 87 (on the side toward the fixed knife 11) and adjacent to the through-hole 87. The rib 88 extends on the transverse axis X. The top of the rib 88 is a support surface 88*a* that supports from below the movable knife 31 riding on the platform 85. The support surface 88*a* is an arch that projects up in the middle on the transverse axis X. When the movable knife 31 resting on the platform 85 is seen from the vertical axis Z, the axial center of the arch (support surface 88*a*) is on the center line of the movable knife 31 on the transverse axis X.

A curved protrusion 89 is formed along the open edge of the through-hole 87 in the platform 85 on the front side of the rib 88 (the opposite side as the fixed knife 11). The curved protrusion 89 is contiguous to the rib 88. The platform 85 also has a front rectangular protrusion 90 formed on the front side of the curved protrusion 89. The front rectangular protrusion 90 is contiguous to the front part of the curved protrusion 89. A back rectangular protrusion 91 is disposed contiguously to the center of the rib 88 on the transverse axis X. The tops of the curved protrusion 89, the front rectangular protrusion 90, and the back rectangular protrusion 91 are lower than the support surface 88*a*.

When attaching the movable knife 31 from above the cutter drive plate 54 to the cutter frame 53, as shown in FIG. 5A and FIG. 5B, the movable knife side guide pin 44 extending down from the movable knife 31 passes through the through-hole 87 in the slide 80A, and then enters the frame-side guide hole 63 in the cutter frame 53. As a result, the support surface 88*a* of the slide 80A supports the protrusion 46 of the movable knife 31 from below. The slide 80A also moves on the longitudinal axis Y with the movable knife 31 by means of the movable knife side guide pin 44.

The screw 68 is then inserted from above the movable knife 31 through the movable knife-side guide slot 42 to the through-hole 65 in the cutter frame 53, and the screw 68 is screwed into the screw retainer 67. As a result, the head of the screw 68 contacts the edges of the movable knife-side guide slot 42 in the movable knife 31 from above, and prevents the movable knife 31 from falling out of the cutter frame 53. Note that the screw 68 screws into the threaded hole 70 in the screw retainer 67 until the coil spring 71 is compressed. The dropout prevention mechanism 66 of the movable knife 31 embodied by the screw retainer 67, screw 68, and coil spring 71 therefore exerts an urging force urging the movable knife 31 toward the cutter frame 53. As a result, the cutting edge 31*a* at the back of the movable knife 31 is pushed from above by the urging force of the dropout prevention mechanism 66 to the fixed knife 11. The protrusion 46 at the front end of the movable knife 31 is also pushed from above to the support surface 88*a* of the slide 80A.

With the slide 80A according to this embodiment, when the movable knife 31 reaches the cutting position 31B, the position (orientation) of the movable knife 31 is desirably aligned with the cutting edge 11*a* of the fixed knife 11.

More specifically, as shown in FIG. 8, when the movable knife 31 is at the cutting position 31B, the middle of the transverse axis X of the cutting edge 31*a* of the movable knife 31 is pressed from above by the dropout prevention mechanism 66 to the cutting edge 11*a* of the fixed knife 11. In addition, the front protrusion 46 of the movable knife 31 is pressed by the dropout prevention mechanism 66 from above to the support surface 88*a* of the slide 80A. Because the support surface 88*a* of the slide 80A curves up in the middle on the transverse axis X, the protrusion 46 of the movable knife 31 is supported by the slide 80A by a support part 92 extending on the longitudinal axis Y. The orientation of the movable knife 31 can therefore be displaced to match the orientation of the cutting edge 11*a* of the fixed knife 11. Because a gap is thus not formed between the fixed knife 11 and movable knife 31, the cutter 10 can always cut the recording paper 101 with good cutting quality.

When the slide supports the movable knife 31 with a flat support surface, cutting the recording paper 101 desirably may not be possible if the cutting edge 11*a* of the fixed knife 11 and the support surface of the slide are not parallel. More specifically, if the protrusion 46 of the movable knife 31 is pressed against a flat support surface by the dropout prevention mechanism 66, the movable knife 31 assumes the same orientation as the support surface, and deviation from this orientation is difficult. When the cutting edge 11*a* of the fixed knife 11 and the support surface of the slide are not parallel and the movable knife 31 reaches the cutting position 31B, the orientation of the movable knife 31 may be affected by the support surface of the slide and become skewed to the fixed knife 11, and a gap may result between the fixed knife 11 and the movable knife 31. This possibility can be eliminated by using the slide 80A.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A cutter drive mechanism for moving a movable knife toward and away from a fixed knife, the cutter drive mechanism comprising:

two cutter drive gears configured to be driven synchronously, each cutter drive gear comprising a drive pin at a position offset from an axial center of the cutter drive gear; and a cutter drive plate that is formed as a separate piece from the movable knife, and that is disposed between the two cutter drive gears and the movable knife in a thickness direction of the two cutter drive gears and the movable knife, the cutter drive plate comprising two slots in which the drive pins of the cutter drive gears are respectively located, and a movable knife drive pin configured to be located in a round hole of the movable knife;

wherein the two cutter drive gears are configured to move the cutter drive plate in a direction of travel toward and away from the fixed knife; and wherein the movable knife is attached to the cutter drive plate so as to move in the direction of travel in conjunction with movement of the cutter drive plate in the direction of travel.

2. The cutter drive mechanism described in claim 1, wherein:

the round hole is disposed toward a center of a cutting edge of the movable knife in a direction transverse to the direction of travel of the movable knife.

3. The cutter drive mechanism described in claim 2, further comprising:

a guide mechanism configured to guide the movable knife in the direction of travel.

4. The cutter drive mechanism described in claim 1, wherein:

when the cutter drive gears rotate one revolution, the movable knife is configured to move bidirectionally between a cutting position at which a cutting edge of the movable knife and a cutting edge of the fixed knife cross, and a standby position at which there is a gap between the cutting edge of the movable knife and the cutting edge of the fixed knife;

the slots extend in a direction transverse to the direction of travel of the movable knife;

a curved part that curves in an arc in a direction away from an axis of rotation of the cutter drive gears is disposed in a middle of each slot in the direction in which the slots extend; and the drive pin is in the curved part when the movable knife is in the standby position.

5. A cutter comprising:

the fixed knife;

the movable knife; and the cutter drive mechanism described in claim 1.

6. A printer comprising:

a printhead;

the cutter described in claim 5; and a conveyance mechanism configured to convey sheet media through a conveyance path passing a printing position of the printhead and a cutting position of the cutter.

* * * * *